US008955998B2

(12) United States Patent
Wong et al.

(10) Patent No.: US 8,955,998 B2
(45) Date of Patent: Feb. 17, 2015

(54) LIGHTING ASSEMBLY FOR CEILING BOARD

(71) Applicant: LED House SDN BHD, Penang (MY)

(72) Inventors: Chee Keat Wong, Penang (MY); Weng Ghee Wong, Selangor (MY)

(73) Assignee: LED House SDN BHD, Penang (MY)

( * ) Notice: Subject to any disclaimer, the term of this patent is extended or adjusted under 35 U.S.C. 154(b) by 0 days.

(21) Appl. No.: 13/685,429

(22) Filed: Nov. 26, 2012

(65) Prior Publication Data

US 2013/0083514 A1 Apr. 4, 2013

Related U.S. Application Data

(63) Continuation of application No. PCT/MY2011/000173, filed on Jul. 22, 2011, and a continuation of application No. PCT/MY2012/000279, filed on Nov. 21, 2012.

(30) Foreign Application Priority Data

Sep. 12, 2012 (MY) ..... PI 2012700636

(51) Int. Cl.
*F21S 8/00* (2006.01)
*F21V 1/00* (2006.01)
(Continued)

(52) U.S. Cl.
CPC ..... *F21S 8/046* (2013.01); *F21S 8/026* (2013.01); *F21S 8/06* (2013.01); *E04B 9/32* (2013.01); *F21V 33/0012* (2013.01); *F21S 2/00* (2013.01); *F21S 8/024* (2013.01); *F21S 8/063* (2013.01); *F21V 21/046* (2013.01);
(Continued)

(58) Field of Classification Search
CPC ..... F21Y 2103/003; F21Y 2103/00; F21Y 2111/005; F21V 15/01; F21V 7/005; F21V 21/00; F21V 19/0075; F21V 19/045
USPC ..... 362/147, 221–225, 217.05–217.09, 362/217.1, 217.11–217.17, 249.02
See application file for complete search history.

(56) References Cited

U.S. PATENT DOCUMENTS 6,305,816 B1 * 10/2001 Corcorran et al. ..... 362/147
6,752,513 B2 * 6/2004 Plunk ..... 362/150
(Continued)

FOREIGN PATENT DOCUMENTS

KR 20-0391541 Y1 8/2005
KR 10-0808147 B1 3/2008
KR 10-0828299 B1 5/2008

OTHER PUBLICATIONS

International Search Report for PCT/MY2011/000173, dated Dec. 14, 2011 (3 pages).

*Primary Examiner* — Peggy Neils
*Assistant Examiner* — William N Harris
(74) *Attorney, Agent, or Firm* — Hamre, Schumann, Mueller & Larson, P.C.

(57) ABSTRACT

The present invention discloses a ceiling, in particular to a ceiling board with modularized composite LED lamps. The ceiling comprises a light bar (2), a ceiling board (1*a*, 1*b*). The ceiling is characterized in that a plurality of LED lamps are fixedly embedded in a light bar (2); the bar (2) is mounted on the side edges of two adjoining ceiling boards (1) fitted and held firmly by the standard ceiling grids.

19 Claims, 14 Drawing Sheets

(51) Int. Cl.

| | |
|---|---|
| ***F21V 5/00*** | (2006.01) |
| ***F21V 7/00*** | (2006.01) |
| ***F21V 21/00*** | (2006.01) |
| ***F21S 4/00*** | (2006.01) |
| ***F21V 23/02*** | (2006.01) |
| ***F21S 8/04*** | (2006.01) |
| ***F21S 8/02*** | (2006.01) |
| ***F21S 8/06*** | (2006.01) |
| *E04B 9/32* | (2006.01) |
| *F21V 33/00* | (2006.01) |
| *F21S 2/00* | (2006.01) |
| *F21V 21/04* | (2006.01) |
| *F21Y 101/02* | (2006.01) |
| *E04B 9/00* | (2006.01) |
| *E04B 9/06* | (2006.01) |
| *E04B 9/18* | (2006.01) |

(52) U.S. Cl.

CPC ..... *F21Y 2101/02* (2013.01); *E04B 9/006* (2013.01); *E04B 9/06* (2013.01); *E04B 9/183* (2013.01)

USPC ..... 362/147; 362/217.05; 362/217.12; 362/217.15; 362/217.16; 362/221

(56) References Cited

U.S. PATENT DOCUMENTS

| | | | | |
|---|---|---|---|---|
| 7,674,005 | B2 * | 3/2010 | Chung et al. | 362/223 |
| 2009/0231837 | A1 * | 9/2009 | Kassay et al. | 362/147 |
| 2012/0002406 | A1 * | 1/2012 | Leadford et al. | 362/217.14 |

* cited by examiner

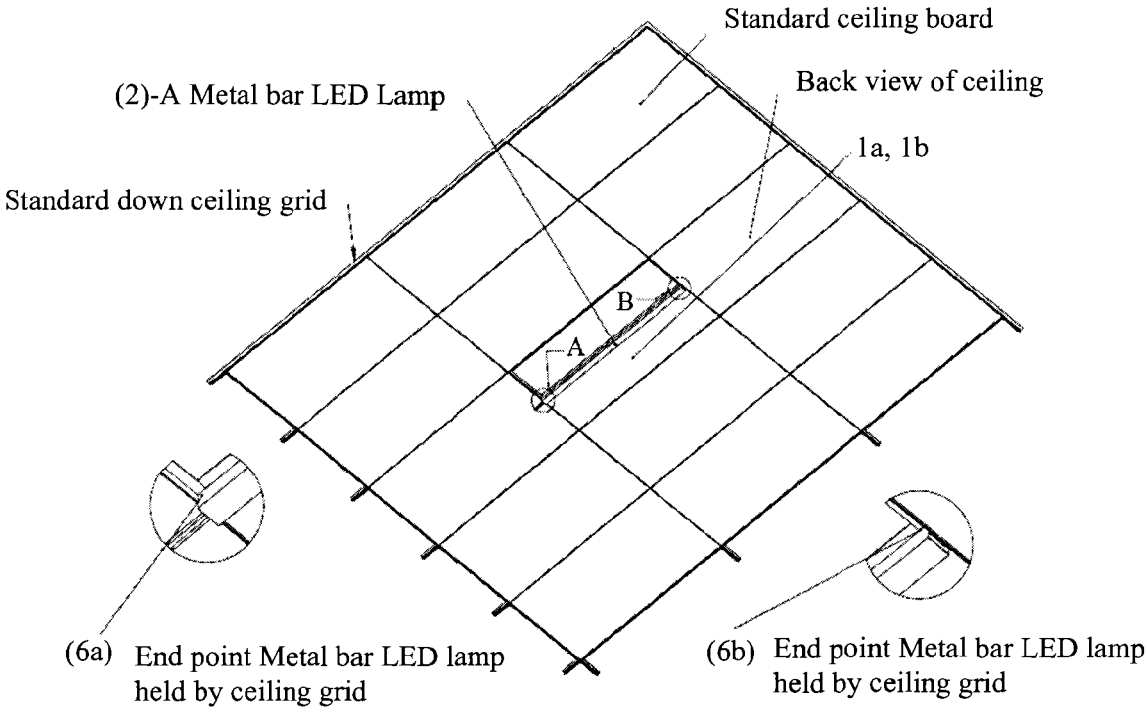
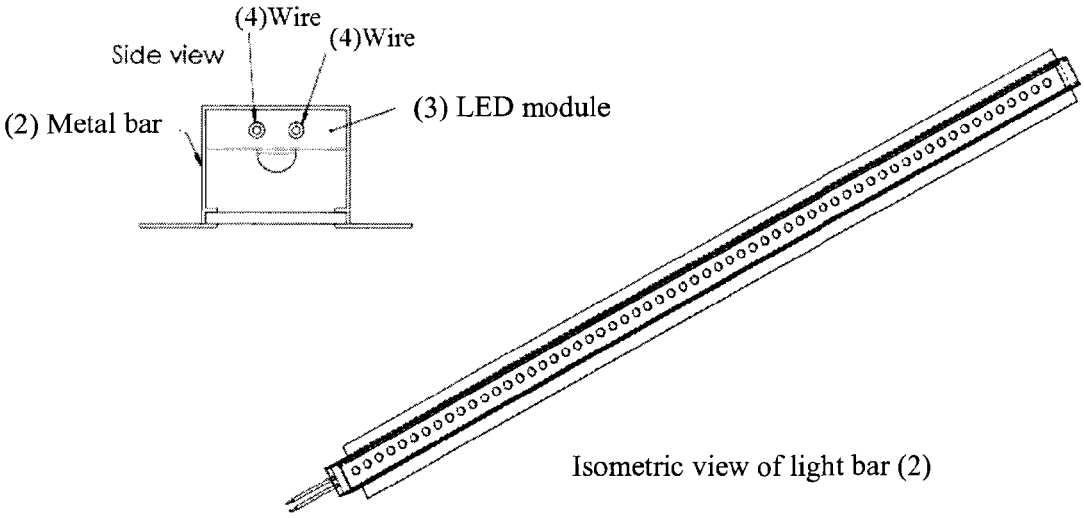
FIG. 2

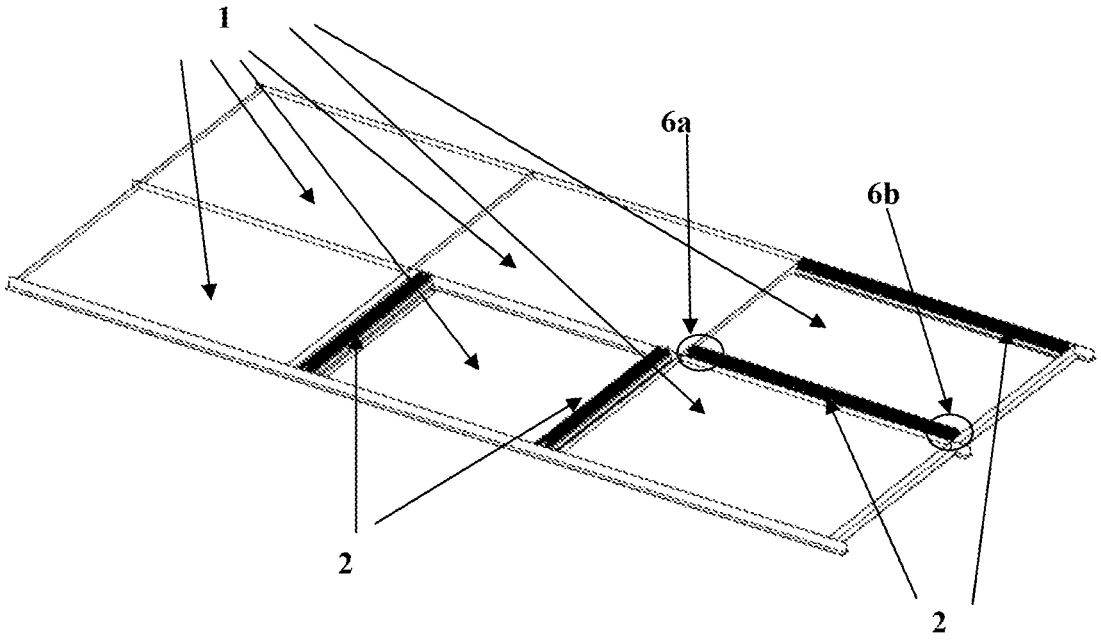
FIG. 7-A
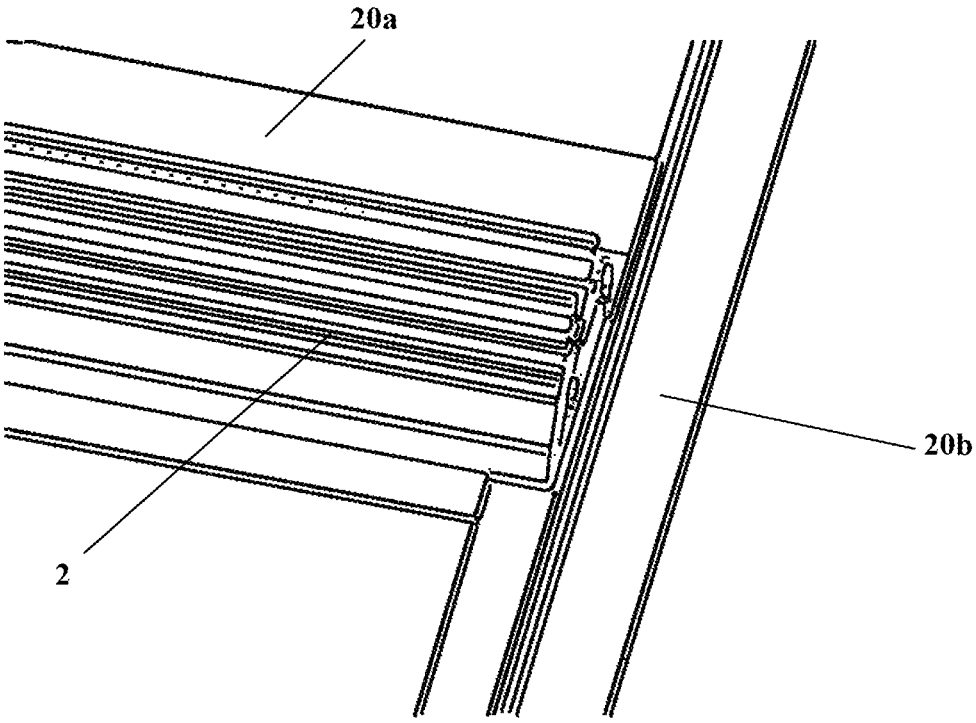
FIG. 7-B

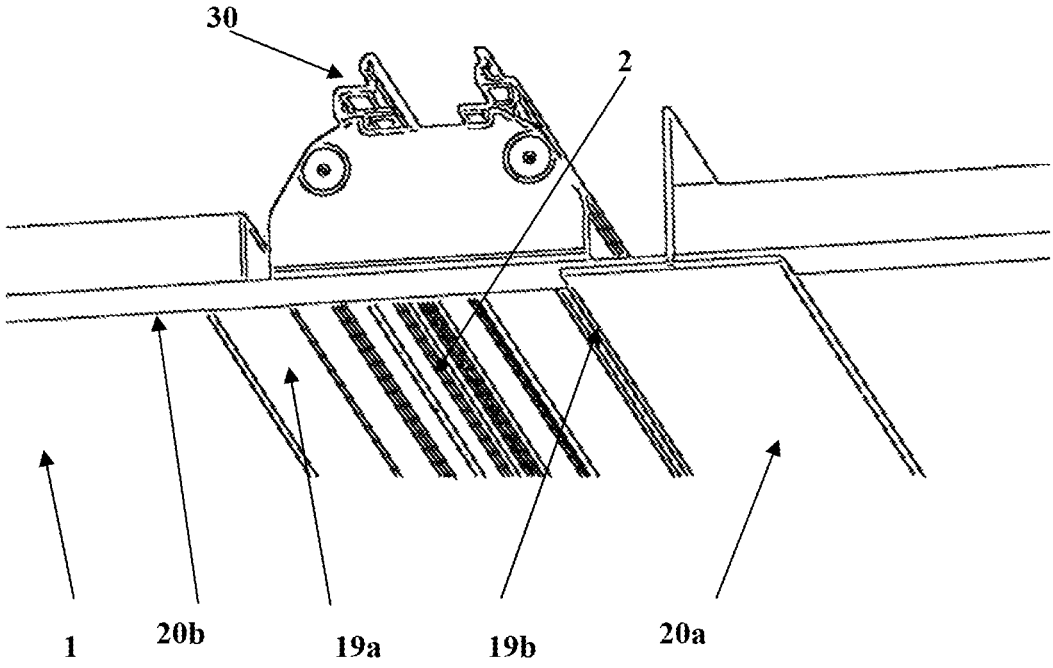
FIG. 8-A
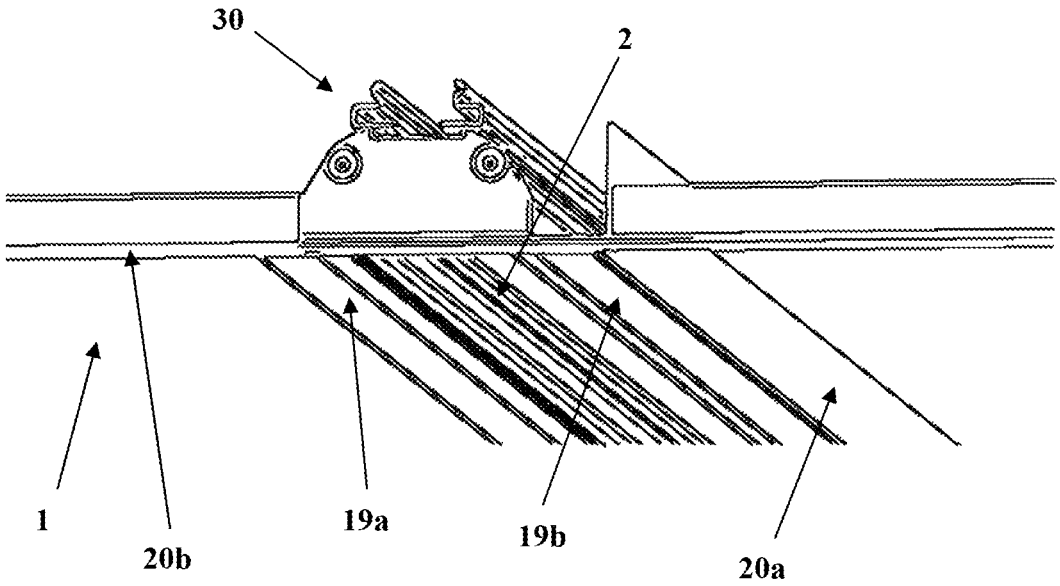
FIG. 8-B

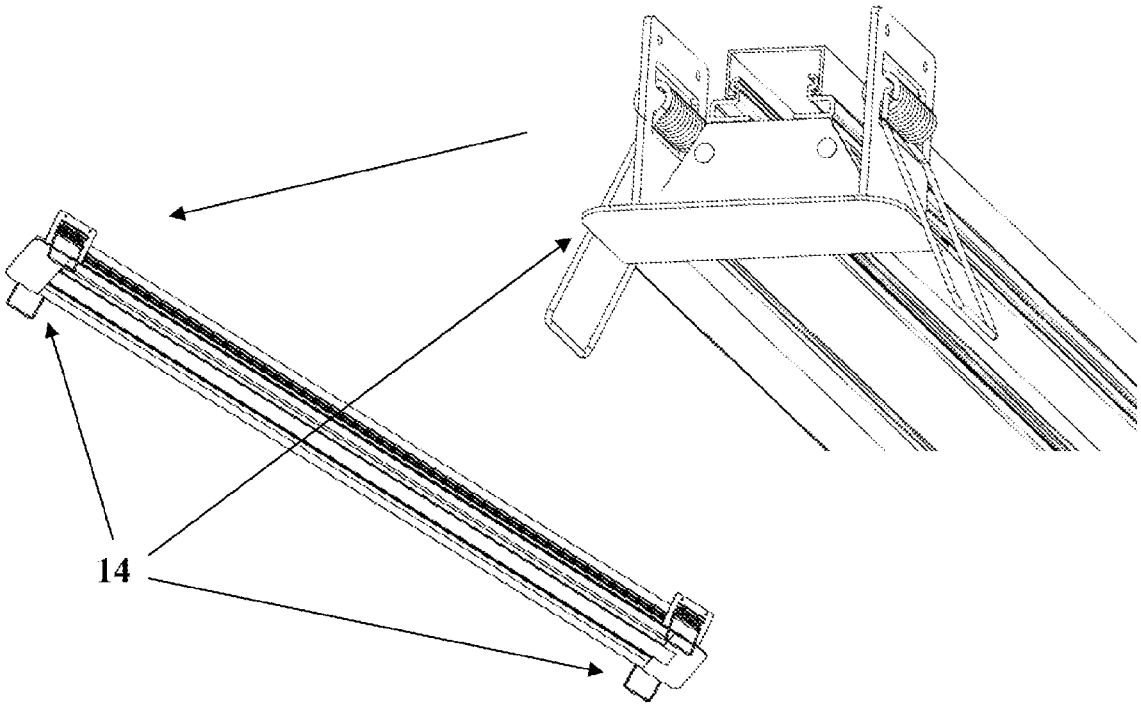
FIG. 14-A
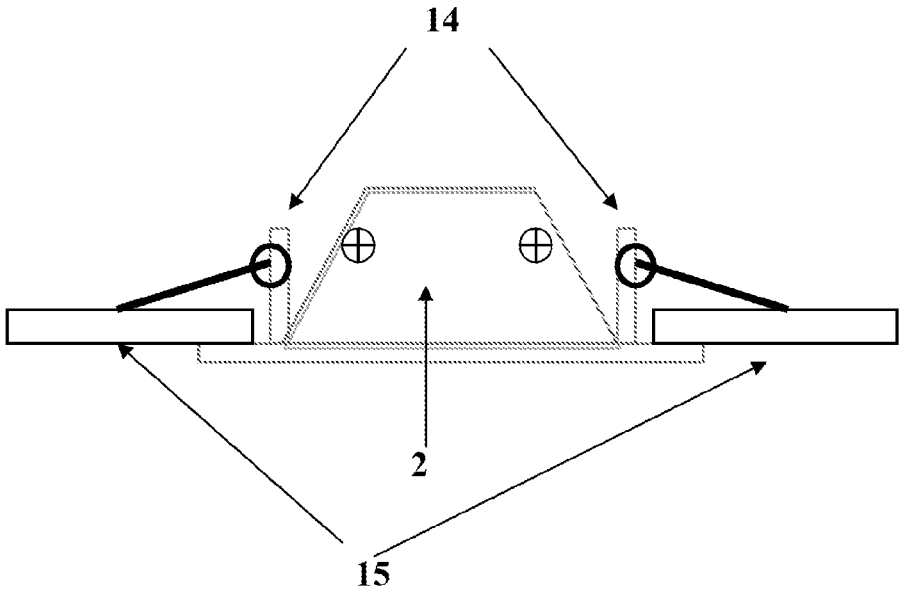
FIG. 14-B

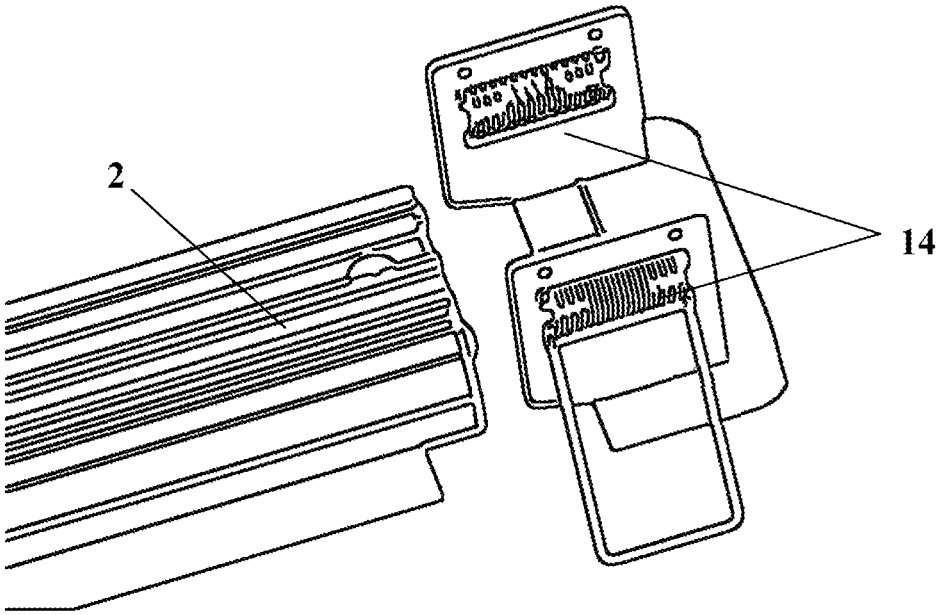
FIG. 15-A
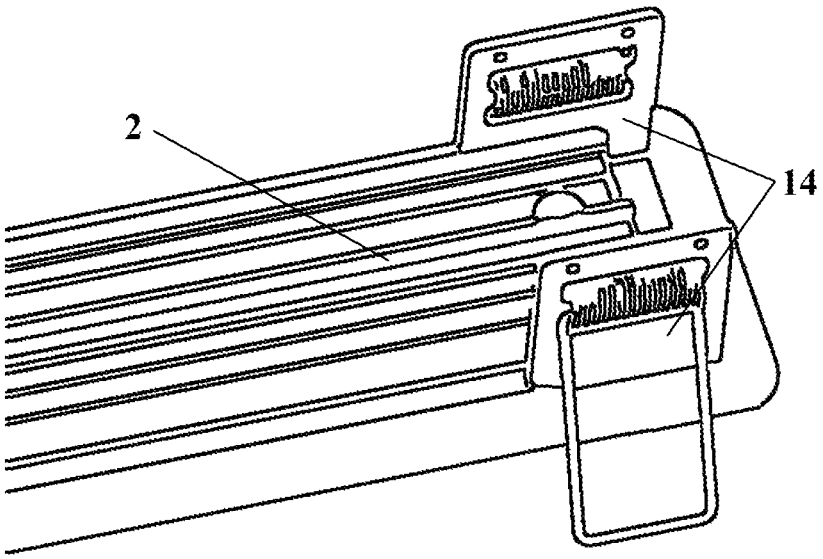
FIG. 15-B

LIGHTING ASSEMBLY FOR CEILING BOARD

TECHNICAL FIELD

The invention relates to light fittings on ceiling boards, and is particularly applicable to light fittings such as modularized composite LED lamps arranged in a metal bar. The assembly illustrated in the present invention has the advantages of simple structure.

BACKGROUND

Conventionally, ceiling boards comprise a grid of intersecting members in the form of metal tracks suspended below a ceiling. The metal tracks have horizontal flanges at their lower ends which are used to support ceiling panels. The cavity formed above the ceiling panel is used to pass electrical service wires to which light fittings of various sorts may be connected. Fluorescent light tubes may typically be attached to fittings placed on the grid tracks, which are approximately the size of the spacing and thus will replace a panel in that spacing.

However, when bulb lights such as halogen lights are used the fittings are smaller and thus entire panels are not removed. Instead modified panels are used and the lamp fitting is either mounted directly on the panel, or else a subsidiary track is fastened to the ceiling underneath the panel, the panel having a hole for the wires to connect to the lights.

Some expense is therefore involved when mounting lamps on existing ceilings because ceiling panels have to be replaced with modified panels. Even when the fittings are placed below the ceiling panels the panels still have to be modified to pass the electrical cables from the ceiling cavity. Halogen lamps have relatively high power requirements and consequently require relatively large wires whose appearance below the ceiling panels would generally be considered unsightly.

The present invention in some embodiments therefore aims to provide electrical fittings such as modularized composite LED lamps that can be attached to a ceiling board arrangement of which said LED lamps are fixedly embedded onto a light bar. The present method of ceiling lighting assembly described does not require modification or replacement of existing ceiling panels or like components as the LED light bar is designed to be firmly fitted and held by the standard ceiling grids.

In addition, the operating life of conventional lighting such as incandescent and fluorescent is in the range of 2 to 8 thousand hours. It is very short compare with the life of the lamps fixture that only consist of mechanical parts. For such reason the conventional lamp (or bulb) is design separately from their fixture for easier maintenance.

The operating life of LED light is in the range from 35 to 60 thousand hours and it is much longer compare with conventional incandescent or fluorescent lamp. Since the replacement of lamp (or bulb) is not that frequent, it is more economical to design the LED lamp and its fixture as one part to reduce the overall material cost. However, the conventional light bar and its fixture only can be installed on the standard ceiling grid.

It would hence be extremely advantageous if the above shortcoming is alleviated by having a lighting profile at the lighting fixture that can be used to facilitate mounting of the light bar at many others area with different installation methods. The present invention is directed to new and useful alternatives to known arrangements.

SUMMARY

In accordance with a first aspect of the invention there is provided an electrical appliance comprising of a metal bar with a plurality of LED lamps embedded within the said bar.

The LED light bar is to be mounted within a ceiling board. The LED bar is specifically adapted for mounting on a member of the ceiling board which is firmly fitted and held by ceiling grid at the two adjoining ends.

The LED light bar is manually releasable fixing to the board of which a configuration such that they can be engaged to ceiling board. The engaging means, and indeed the entire bar, could be made of aluminum material, of a thickness sufficiently small so as not to disturb the positioning of a ceiling boards.

The electrical apparatus, which is LED lamp in this case, will further include an electrical appliance having wiring emerging from the LED bar connected to electrical supply which is to be hidden above the ceiling;

According to a second aspect of the invention there is provided a suspended ceiling grid with a single metal bar comprising a plurality of LED lamps arranged to form part of the grid on the ceiling board. The fitting can be placed at an arbitrary location on the ceiling board and subsequently moved if desired without any residual damage to the ceiling board.

According to a third aspect of the invention there is provided a method of mounting a lamp fitting on a suspended ceiling of the kind having ceiling panels fitted in the spaces defined by the ceiling board, comprising the steps of: attaching the lamp fitting in between two pieces of ceiling board, and running a wire from the fitting towards a power supply above the ceiling through a gap between the track and the ceiling board resting on the track in such a way that the ceiling board is not substantially displaced by the wire.

Lamp fittings according to embodiments of the invention may be applied to existing ceilings without further modification to any component of the ceiling.

The present invention is particularly conceived for low power consumption in the range of 12.5 watt.

Another advantage of the present invention is the easy and convenient fitting of ceiling lights on ceiling boards which requires relatively low power requirements and consequently require relatively small wires whose appearance above the ceiling panels would portray a neat and orderly of wire arrangements.

It is yet another object of the present invention to provide a light bar that can be installed at for example solid ceiling, plaster ceiling, adjacent to the aluminium grid of the suspended ceiling and suspension rod.

It is yet another object of the present invention to provide a light bar that can be installed at any other suitable surface such as metal trunking.

Yet another object of the present invention to provide a light bar that is able to improve cosmetic looks of the ceiling surface or the building structure.

Yet another object of the present invention to provide a light bar that allows for other additional installation methods.

Yet another object of the present invention to provide a light bar that allows the light bar to be installed side by side with the aluminium grid of the suspended ceiling to reduce installation labour.

Yet another object of the present invention to provide a light bar that is able to reduce the installation labour by reducing the board cutting process from two cuttings for one light bar to one cutting for two light bars.

For a better understanding of the invention and to demonstrate how it may be put into practice embodiments of it will now be described with reference to the accompanying drawings.

BRIEF DESCRIPTION OF THE DRAWINGS

FIG. 2 is a view of the placement of lamp fitting in a light bar in accordance with the invention together with an isometric view of the light bar

FIG. 7-A shows an exemplary of the arrangement for each light bar that is installed adjacent to ceiling aluminium grid.

FIG. 7-B shows an enlarged view of the light bar installed adjacent to ceiling aluminium grid by means of the lighting fixture of the present invention.

FIG. 8-A shows the mounting of flange member above the ceiling aluminium grid.

FIG. 8-B shows the mounting of flange member below the ceiling aluminium grid.

FIG. 14-A shows the use of at least two brackets with spring systems for installation of light bar onto plaster ceiling or other ceiling surface.

FIG. 14-B shows a cross section view of the flange member of the lighting profile used to shield the unevenness cutting edge of the cut hole at the plaster ceiling.

FIG. 15-A show the bracket with spring systems before connected with the lighting fixture.

FIG. 15-B show the bracket with spring systems after connected with the lighting fixture.

DETAILED DESCRIPTION OF THE INVENTION

Figure 1:
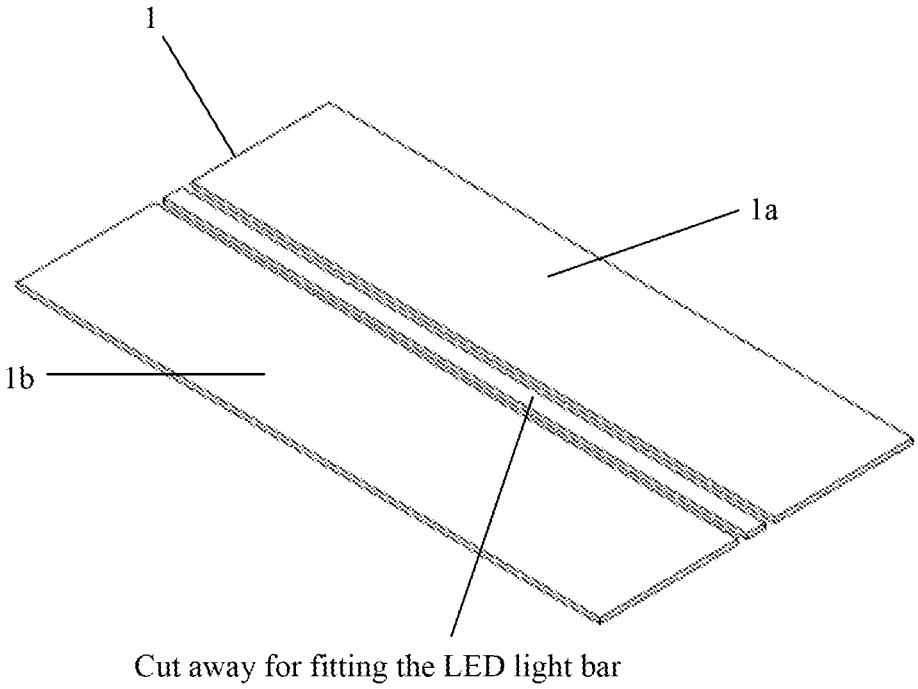
FIG. 1 is a view of the ceiling board before the fitting of the lamp fixture

In FIG. 1 the ceiling board (1) which is used more commonly in offices is cut into two pieces. A light bar (2) which is readily fixed embedded with a plurality of LED lamps (3) is then mounted to the side edge of the wall of the first ceiling board (1*a*). The light bar (2) has a generally rectangular shape in plan. It is understood that a fraction of the ceiling board is cut away for the fitting of the LED light bar (2) fixed to the adjoining ceiling board (1*a*, 1*b*).

Figure 3:
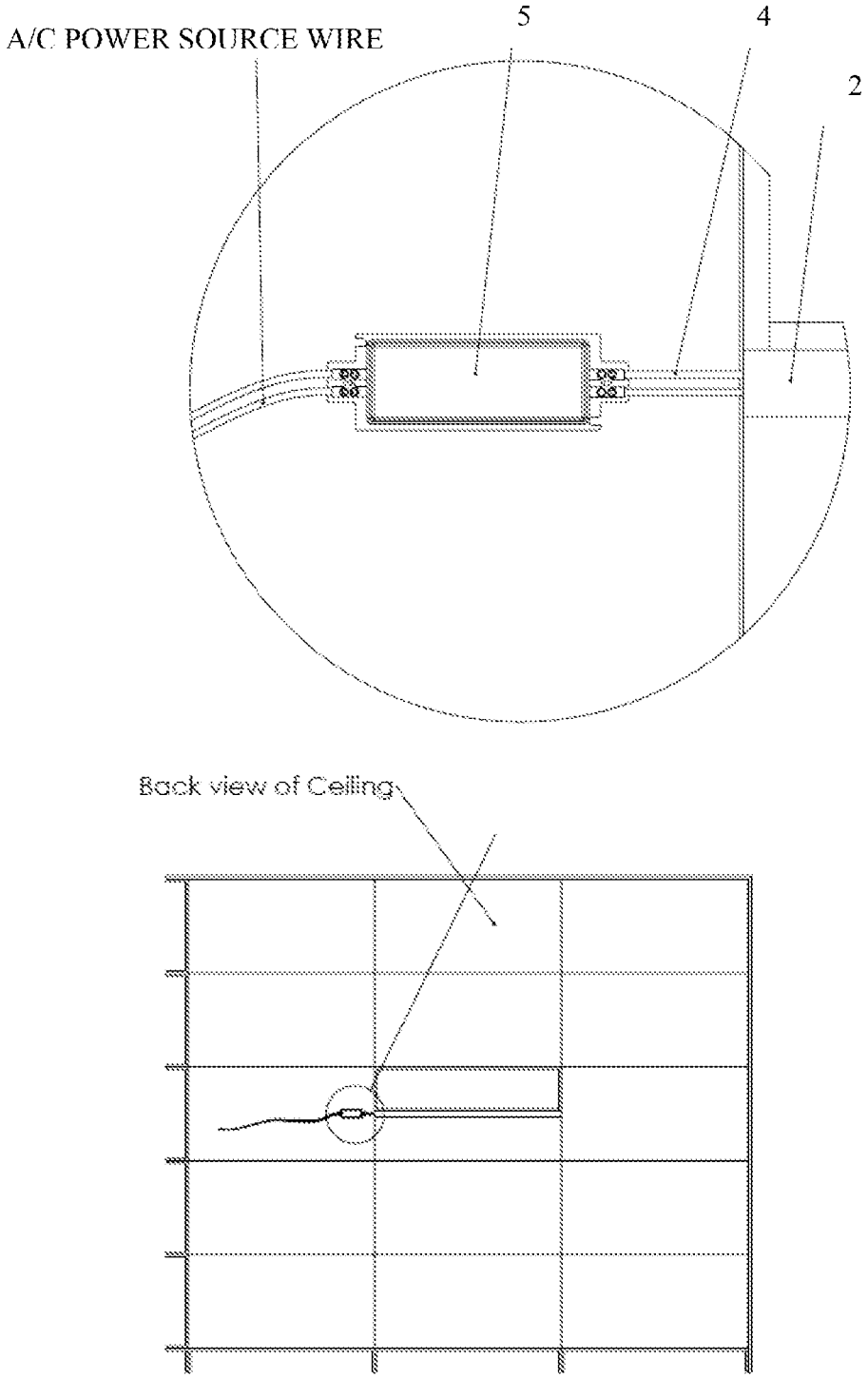
FIG. 3 shows the light fitting connected to a power supply

The base of the LED lamps (3) fitted inside the light bar (2) has a recess into which the wirings (4) are connected to a power supply (5) shown in FIG. 3. The power supply (5) is to be hidden inside the ceiling.

Figure 4:
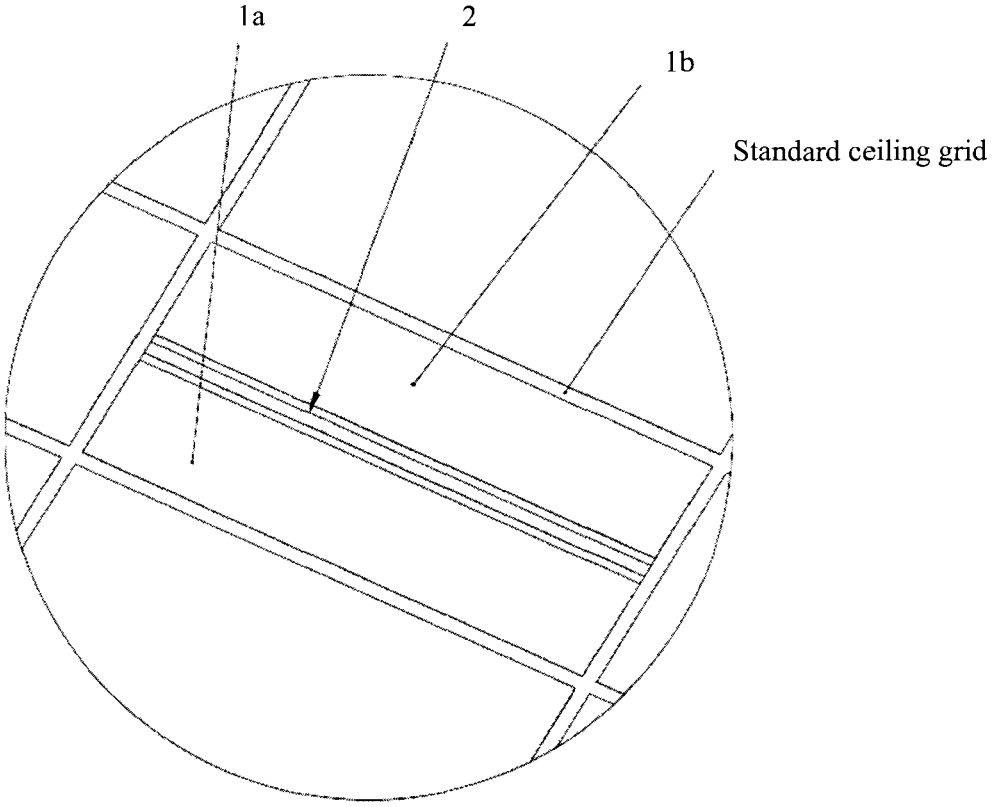
FIG. 4 is a view of the lamp fitting mounted on a ceiling board

The second ceiling board (1*b*) is then mounted to adjoining LED light bar (2), each of which has a cross-section which the contact surfaces of the LED light bar (2) and the ceiling board is attached together, of which the two ends (6*a*, 6*b*) of the LED light bar (2) is adapted to be fitted and held firmly by the standard ceiling grids, which forms the part that is visible to the occupant of the room in which the ceiling is fitted as shown in FIG. 2 and FIG. 4.

Figure 5:
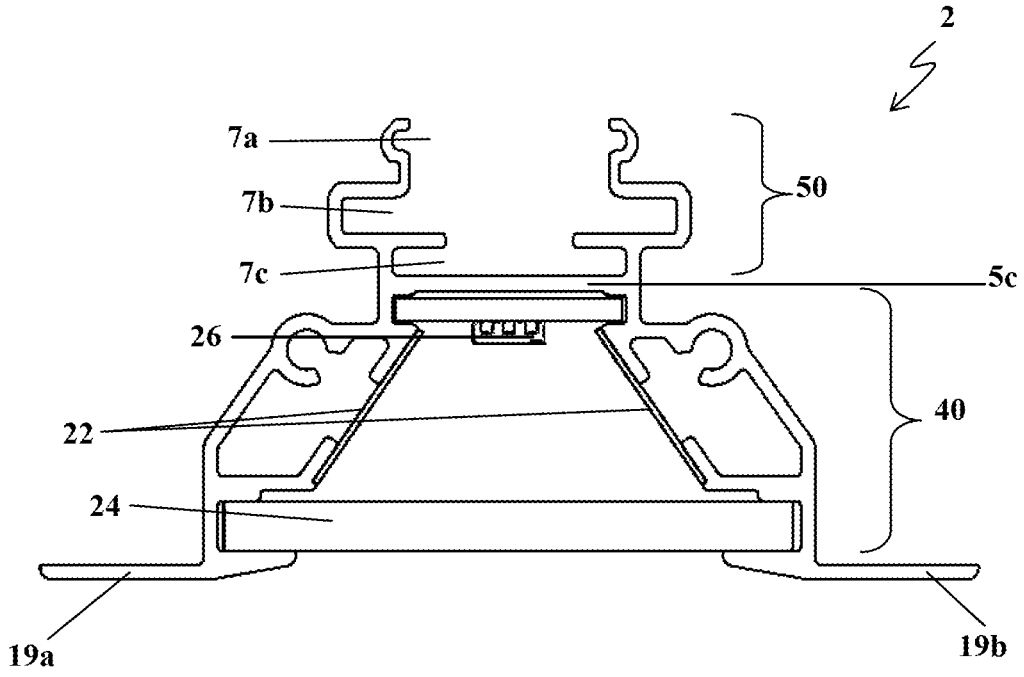
FIG. 5 shows a cross sectional view of an exemplary of a light bar assembly of the present invention.
Figure 6:
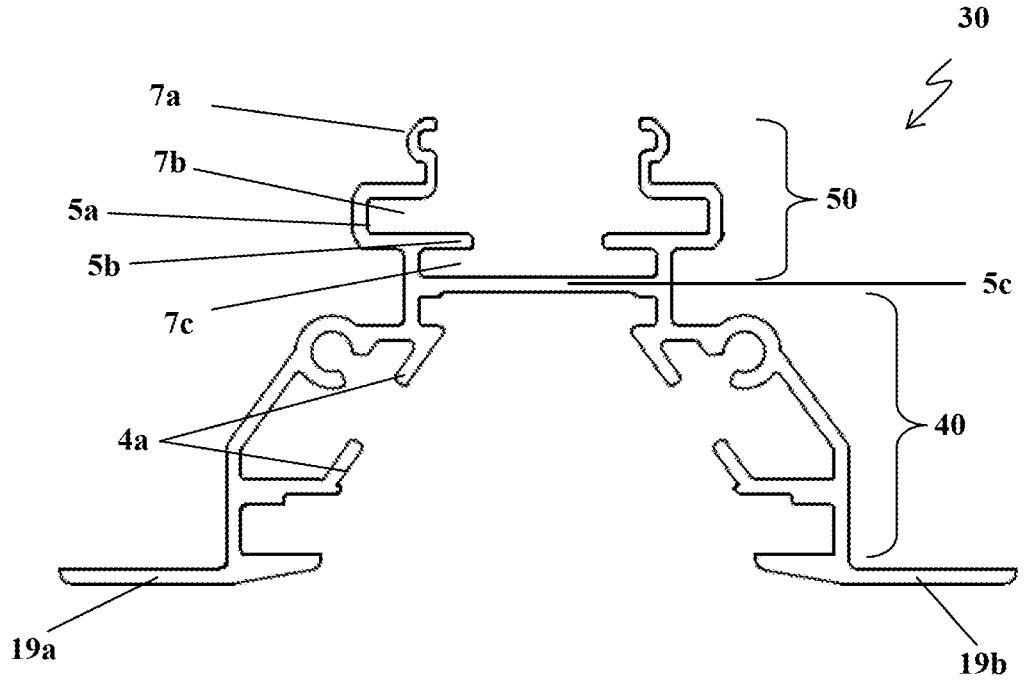
FIG. 6 shows a cross sectional view of an exemplary of the lighting fixture of the present invention.

Referring now to FIG. 5, there is shown a cross sectional view of an exemplary of a light bar assembly (2) for mounting to ceiling system or any suitable surface such as but not limited to building structure, wall and furniture structure. Said light bar assembly (2) comprises of at least one light source module (26), at least one reflector (22), at least one cover (24) and at least one lighting fixture (30). Said light source module (26) and said reflector (22) is the lighting components of said light bar for light illuminations. Said lighting fixture (30) is used for holding and supporting said lighting components and said cover (24). Said lighting fixture (30) is a lighting profile to facilitate mounting of said light bar to ceiling system or at least portion of the ceiling system. FIG. 6 shows a cross sectional view of an exemplary of said lighting fixture (30).

Referring now to FIG. 5 and further substantiated with FIG. 6 said lighting fixture (30) of the present invention is an elongated lighting profile comprises of at least one mounting portion (40) and at least one supporting portion (50) being positioned on top of said mounting portion (40) to facilitate mounting of light bar to at least portion of the ceiling system. Said mounting portion (40) is provided with an elongated channel with at least one engaging member (4*a*) for engaging and holding of said lighting components such as but not limited to light source module (26) and said reflector (22) as well as said cover (24) securely. The shape of said elongated channel and the design of said engaging member (4*a*) can be varied depending on the type and the size of said lighting components to be engaged with. Said supporting portion (50) is used to facilitate installation of the light bar at any suitable surface such as but not limited to building structure, wall and furniture structure. Typically said supporting portion (50) comprises of a plurality of receiving slots that can be designated as first receiving slot (7*a*), second receiving slot (7*b*) and third receiving slot (7*c*). Said first receiving slot (7*a*) is the upper most receiving slot formed from a pair of opposing curvilinear groove. Said second receiving slot (7*b*) is the middle slot formed from a pair of opposing concave space that is respectively defined by its outwardly protruded sidewalls (5*a*). Immediately below the second receiving slot (7*b*) is the third receiving slot (7*c*) that is a lower slot formed between a pair of inwardly extending arm (5*b*) and a laterally disposed rib (5*c*). Said laterally disposed rib (5*c*) is also a connecting member that is positioned between said mounting portion (40) and said supporting portion (50) to connect said mounting portion (40) and said supporting portion (50) together. Both said plurality of receiving slots at said supporting portion (50) extends along the longitudinal axis from one end to the other and thereby creating a channel with plurality of receiving slots. Each of said first receiving slot (7*a*), second receiving slot (7*b*) and third receiving slot (7*c*) can be used to place any wiring during the installation of the light bar. The groove at said first receiving slot (7*a*) is used to latch any trunking cover such as PVC trunking cover in order to cover the wiring being placed therein. At least a pair of opposing flange member (19*a*, 19*b*) is positioned at the lower part of said mounting portion (40) and extended outwardly to engage to the ceiling surface or any other building structure.

The lighting fixture (30) of the present invention can be used to facilitate in installation of the light bar at any suitable surface. Referring to FIG. 7-A, there is shown an exemplary of the arrangement for each light bar (2) that is installed adjacent to ceiling aluminium grid (20*a*). This is further substantiated by FIG. 7-B showing an enlarged view of said light bar (2) installed adjacent to ceiling aluminium grid (20*a*) by means of said lighting fixture (30) of the present invention. The two ends (6*a*, 6*b*) of the light bar (2) are specifically adapted to be fitted and held firmly by the ceiling aluminium grid (20*b*). It can be seen that only one side of the light bar (2) is mounted onto side edge wall of the ceiling board (1), while the other side of the light bar (2) is mounted adjacent to ceiling aluminium grid (20*a*). This installation method could be in such a way that the flange member (19*a*, 19*b*) of said lighting fixture (30) is mounted above the ceiling aluminium grid (20*a*) or mounted below the ceiling aluminium grid (20*a*). FIG. 8-A shows the mounting of said flange member (19*a*, 19*b*) above the ceiling aluminium grid (20*a*) and FIG. 8-B shows the mounting of said flange member (19*a*, 19*b*) below the ceiling aluminium grid (20*a*). Such installation is able to reduce the installation labour by reducing the board cutting process from two cuttings for one light bar to one cutting for two light bars. Such installation also can be carried out by having slight modification towards the flange member (19*a*, 19*b*) of said lighting fixture (30) of the present invention.

Figure 9:
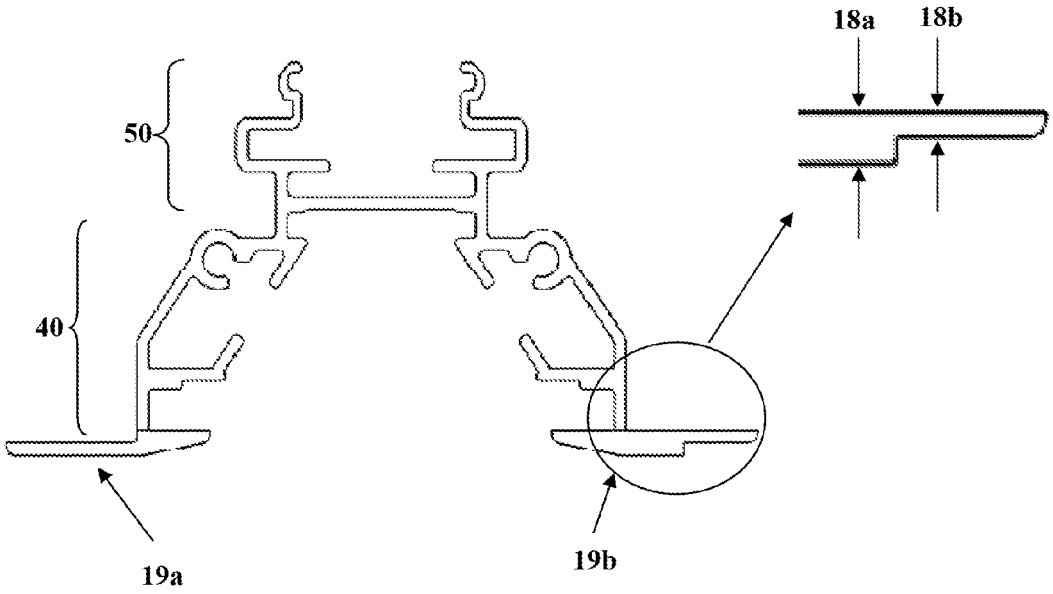
FIG. 9 shows a cross section view of the lighting fixture of the present invention with a cut-away portion at the flange member.
Figure 10:
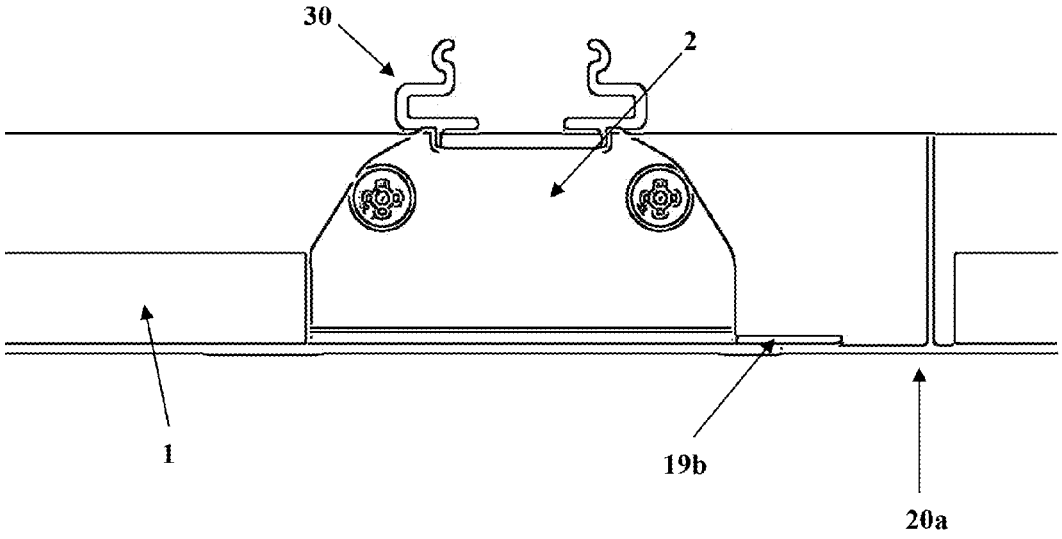
FIG. 10 shows an exemplary cross section view of the installed light bar by using the lighting fixture of the present invention.

Referring now to FIG. 9, there is shown a cross sectional view of said lighting fixture (30) of the present invention whereby one of the flange members (19*b*) is provided with a cut-away portion at the bottom part of said flange member (19*b*) and thereby forming a thinner edge (18*b*) at said flange member (19*b*). FIG. 10 shows an exemplary cross section view of the installed light bar by using said lighting fixture (30) whereby the thinner edge (18*b*) of said flange member (19*b*) is positioned inside and above the ceiling aluminium grid (20*a*) and a thicker flange (18*a*) being positioned next to and in-line with the visible bottom exposed surface of the ceiling aluminium grid (20*a*). Thus, by having the cut-away portion at said flange member (19*b*) of the lighting profile (30), this will improve the cosmetic looks at the ceiling surface.

Figure 11:
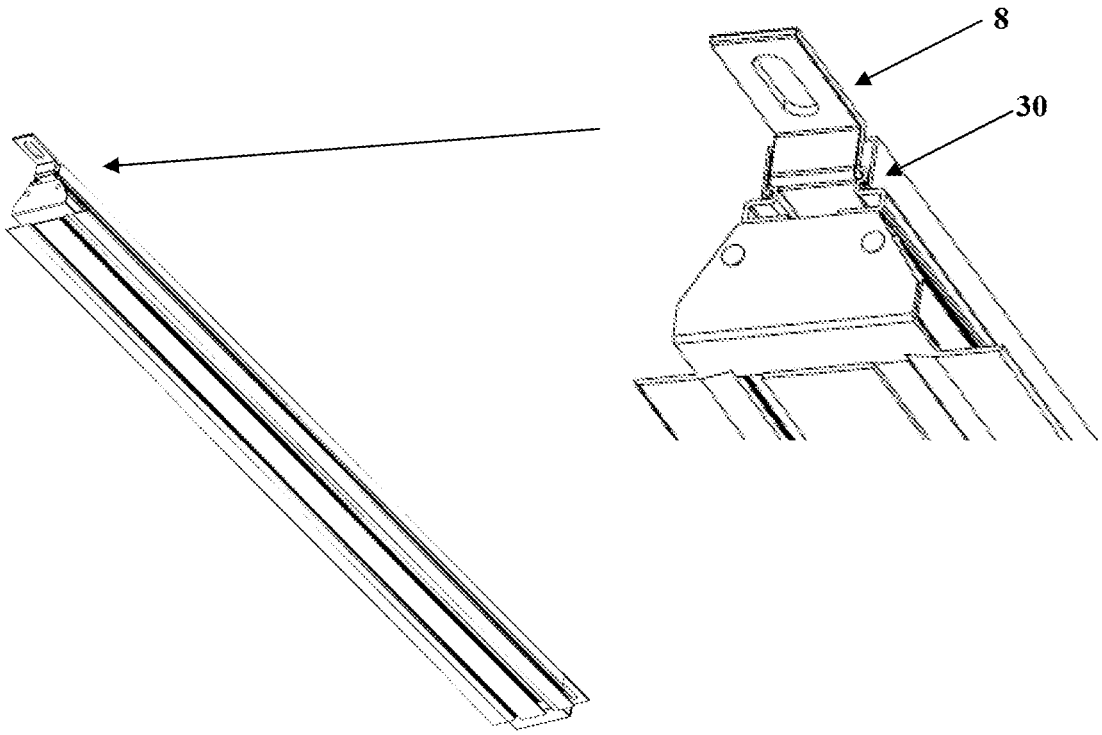
FIG. 11 shows an exemplary on the use of Z-shaped bracket for installation of light bar onto a solid surface.

Referring now to FIG. 11, there is shown an exemplary on the use of at least two Z-shaped bracket (8) for installation of light bar onto a solid surface such as wooden or concrete ceiling or wall surface. Z-shaped bracket (8) is typically comprises of three flat portions (not shown) whereby the first portion and the third portion extend perpendicularly in opposite direction from the opposite end of second portion and substantially forming a Z-shaped configuration. Said first portion and said third portion of the Z-shaped bracket (8) is typically comprises of at least one mounting hole (not shown) so that either one of said portion is attached and secure onto the solid surface by fastening means (not shown) through the mounting hole and the other portion is slotted into either one of the receiving slot of said lighting fixture (30) of the present invention. Said first receiving slot (7*a*) or second receiving slot (7*b*) or third receiving slot (7*c*) of said lighting fixture (30) can be used for the Z-shaped bracket (8) to be slotted into to hold the entire light bar (2). However, it shall be understood that any other shape of bracket can be used as long as the light bar can be attached and secured to the solid surface.

Figure 12:
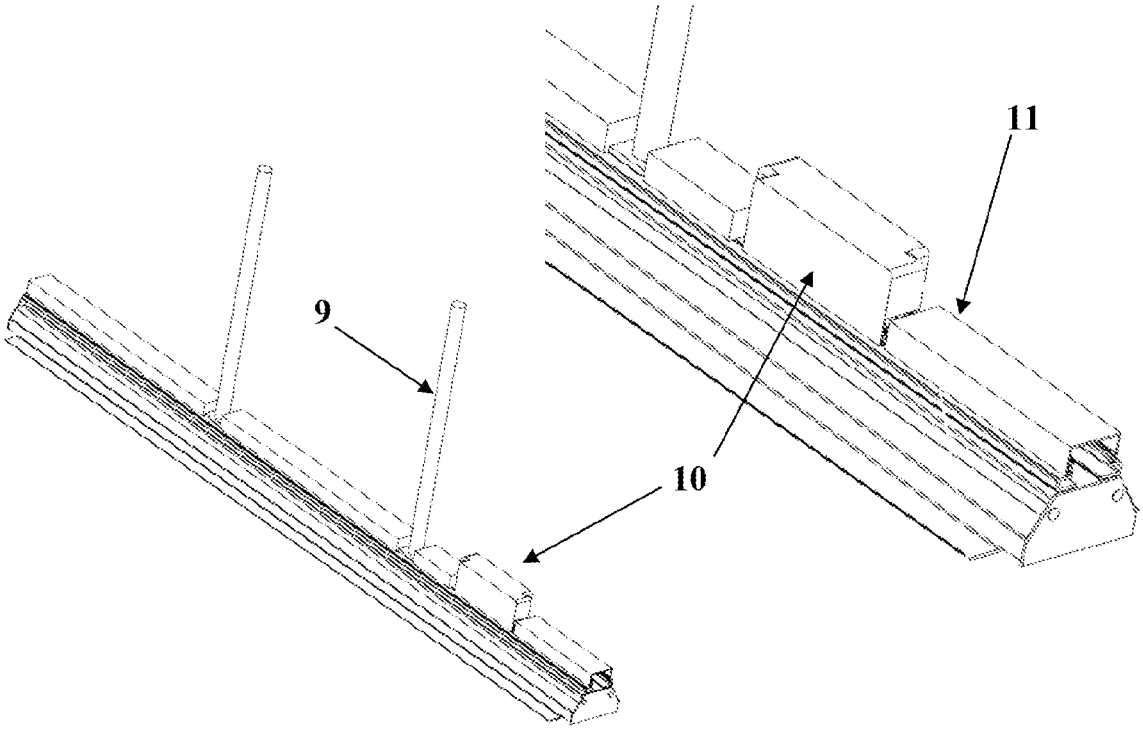
FIG. 12 shows the use of suspension rod for installation of light bar.
Figure 13:
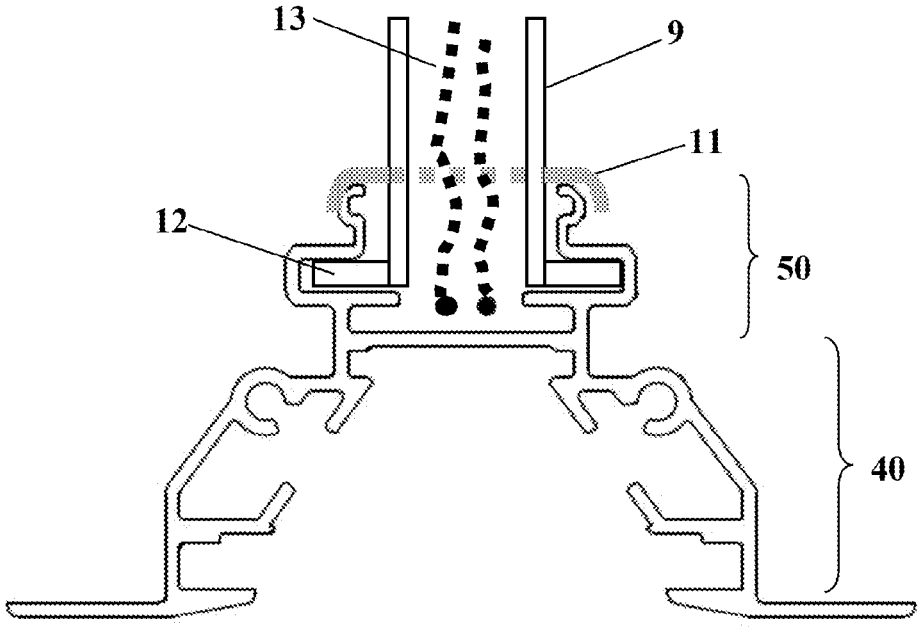
FIG. 13 shows a cross section view of lighting fixture used to hold the nut of the suspension rod.

Referring now to FIG. 12, there is shown the use of suspension rod (9) for installation of light bar (2). Standard suspension rod is a common accessory that is used to install fluorescent lamp with bare channel casing. However, by using of the lighting fixture (30) of the present invention, light bar (2) can be installed directly to the suspension rod without the needs of fluorescent bare channel casing. As shown in FIG. 13, said second receiving slot (7*b*) is used to hold the nut (12) of the suspension rod (9). However, it shall be understood that the nut (12) can be slotted into any one of said receiving slot (7*a*, 7*b*, 7*c*). The nut is used to screw and hold the suspension rod (9). Then one end of the suspension rod (9) that is provided with screw thread is inserted into the nut (12). By twisting the suspension rod (9), the nut is then screwed tightly to the rod and therefore light bar is being fastened to the suspension rod (9). In addition, the supply cable (13) from the suspension rod (9) that is connected to at least one power supply or power converter unit (10) can be placed inside said second receiving slot (7*b*) of the lighting fixture (30) and followed by placing a cover (11) on top of said lighting fixture (30) to cover the components being placed therein.

Referring now to FIG. 14-A, there is shown the use of at least two brackets each of which with two spring systems (14) for installation of light bar (2) onto plaster ceiling (15) or other ceiling surface such as wooden ceiling or metal ceiling. Plaster ceiling is a common ceiling available and normally a hole with appropriate shape and size is cut to install lighting fixture such as down light. The light bar (2) also can be installed on the plaster ceiling (15) with the aid of two brackets whereby each of the bracket is provided with two spring systems (14). For such installation, a rectangular hole is first cut at the plaster ceiling. Each of said bracket with two spring systems (14) is then slotted and inserted at both ends of said lighting fixture. The light bar (2) is then inserted into the hole whereby said brackets are used to connect said light bar (2) with the plaster ceiling board (15) and the flange member (19*a*, 19*b*) of the lighting fixture (30) is used to shield the unevenness cutting edge of the cut hole at the plaster ceiling as shown in FIG. 14-B. FIG. 15-A and FIG. 15-B show the said bracket with spring systems before connected with said lighting fixture and after connected with said lighting fixture.

Figure 16:
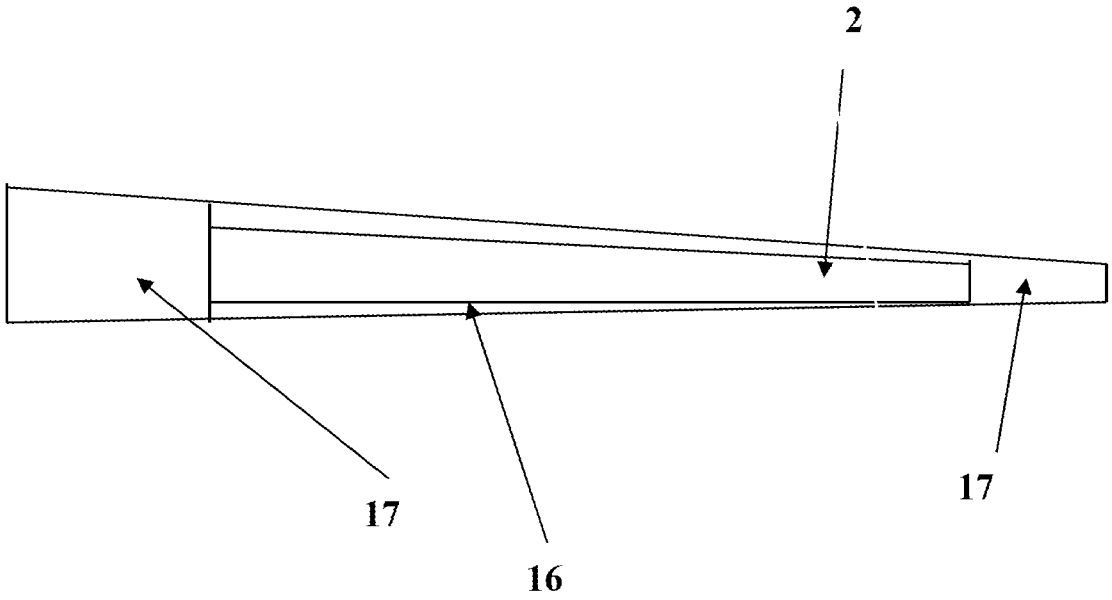
FIG. 16 shows the installation of light bar at metal trunking.
Figure 17:
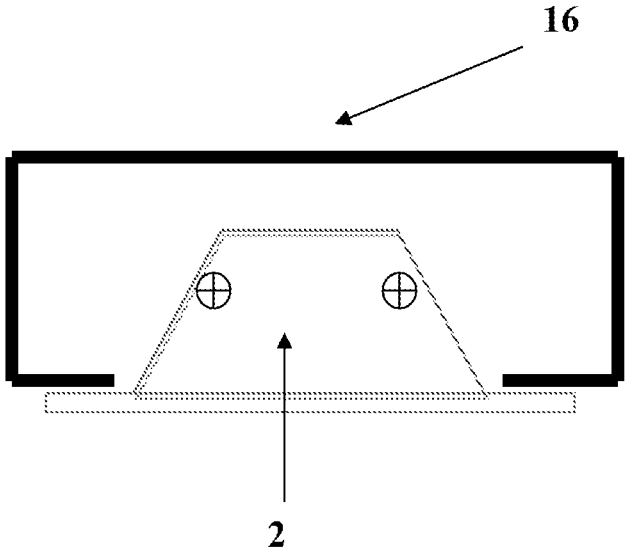
FIG. 17 shows a cross section view of the positioning of the trunking cover.

Referring now to FIG. 16, there is shown the installation of light bar (2) at metal trunking (16). The metal trunking used for the installation of light bar (2) can be a market available metal trunking with the size for example 7.6 cm (3 inches) that is commonly used for wiring purpose. The light bar (2) is first being inserted into the metal trunking (16). Particularly portion of the trunking cover (17) where said light bar (2) is positioned is cut and removed so that said light bar (2) is uncovered by the trunking cover (17) to allow light illumination. The remaining trunking cover (17) at both ends of the lighting fixture is then fastened to the metal trunking (16) to secure the lighting fixture at the metal trunking (16). FIG. 17 shows a cross section view of the positioning of said trunking cover (17). Therefore, by having such an arrangement whereby the trunking cover (17) is fastened, both ends of the lighting fixture is held securely to the metal trunking (16). Additionally, the same trunking also can be used to conceal the supply cable and power supply of the light bar.

Figure 18:
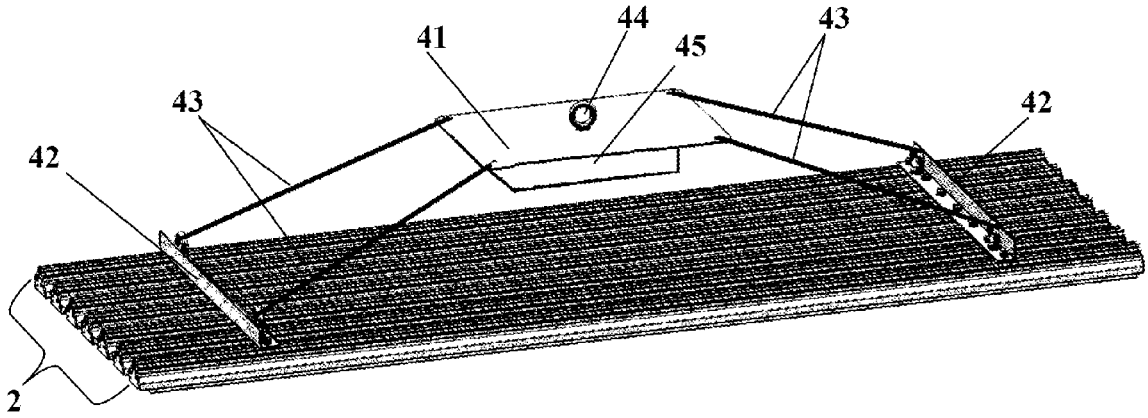
FIG. 18 shows the use of high-bay bracket assembly for installation of a plurality of light bars to ceiling structure.
Figure 19:
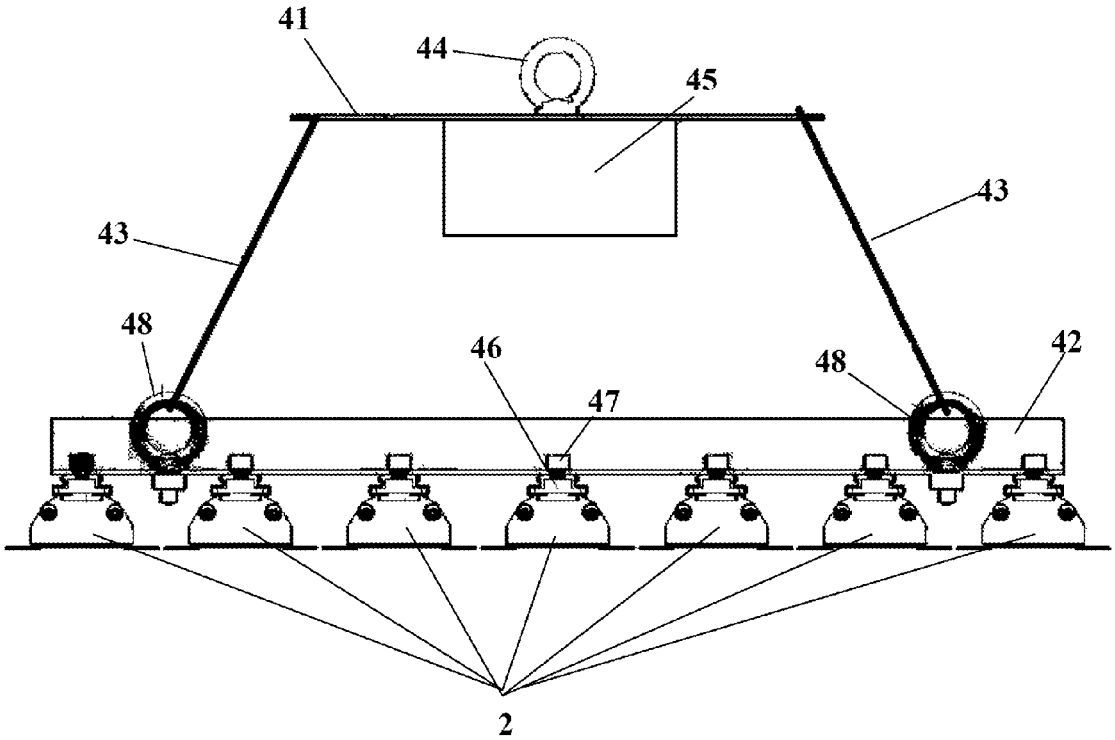
FIG. 19 shows a side view of the high-bay bracket assembly with a plurality of light bars.

Referring now to FIG. 18, there is shown the use of high-bay bracket assembly for installation of a plurality of light bars (2) to ceiling structure. This is further substantiated by FIG. 19 that shows a side view of said high-bay bracket assembly with a plurality of light bars (2). Said high-bay bracket assembly comprises of at least one mounting plate (41) for mounting to the ceiling structure, at least two mounting brackets (42) for said plurality of light bars (2) to be mounted therewith and at least two connecting means (43) whereby at least one connecting means (43) is used to connect each mounting bracket (42) to one side of said mounting plate (41). Said mounting plate (41) is provided with a means for hanging (44) which preferably is a hanging ring to facilitate mounting of said high-bay bracket assembly to ceiling structure. A power controller unit (45) is attached to said mounting plate (41) to control the power supply towards said plurality of light bars (2). Preferably said mounting brackets (42) are positioned perpendicularly at both side of said plurality of light bars (2) and each of said plurality of light bars (2) is being fastened to said mounting brackets (42) by using fastening means such as slotting nut (46) and screw (47). Said mounting bracket (42) further comprises of at least one receiving means (48) and therefore one end of said connecting means (43) is fastened to the receiving means (48) of said mounting bracket (42) while the other end is fastened to the side edge of said mounting plate (41). Preferably two connecting means (43) are used for each mounting bracket (42) and both connecting means (43) are fastened to the receiving means (48) at both end of said mounting bracket (42) so that said mounting bracket (42) is connected to said mounting plate (41) securely. Thus by using of the high-bay bracket assembly, a plurality of light bars (2) can be installed simultaneously to the ceiling. The use of the lighting fixture (30) of the present invention to the light bar (2) is therefore able to facilitate installation of the light bar (2) at different applications and different installation methods. The above mentioned description has identified the installation at for example solid ceiling, plaster ceiling, adjacent to the aluminium grid of the suspended ceiling, metal trunking and suspension rod. The present invention is not restricted to this but may alternatively applied to other building structure or furniture structure as long as said lighting profile (3) is used for the installation of light bar (2).

The fitting described is very inconspicuous and offers a neat yet inexpensive way of fixing the lamp to the ceiling without any modification of the panels or drilling into the grid. Moreover the panels are not disturbed by the thin wires passing between them and the ceiling.

Because the invention fixes the appliance to the ceiling grid by a non-destructive manner, involving frictional engagement or clamping around the outside of the ceiling grid, in the first place the appliance can be fitted at will anywhere on the grid, and in the second place no drilling or intermediate fittings are needed; this is both convenient and preserving of the fabric of the ceiling.

The invention claimed is:

1. A light bar assembly, comprising:

at least one light source module and at least one reflector for light illumination;

at least one mounting portion to hold said light source module and said reflector, wherein a longitudinal axis extends lengthwise along said mounting portion;

a pair of ceiling engaging flange members extending outwardly from opposite sides of said mounting portion;

said mounting portion including two ends in a direction of said longitudinal axis; and said two ends are centrally located such that they are disposed between said ceiling engaging flange members relative to said longitudinal axis, wherein said two ends of said mounting portion extend beyond the ceiling engaging flange members in said direction of said longitudinal axis such that no portion of said ceiling engaging flange members extends outwardly from said two ends of said mounting portion.

2. The light bar assembly as claimed in claim 1, wherein said pair of ceiling engaging flange members are positioned at a lower part of said mounting portion.

3. The light bar assembly as claimed in claim 2, wherein one of said pair of ceiling engaging flange members is provided with a cut-away portion at a bottom part of said one of said pair of ceiling engaging flange members to form an outer thinner portion and an inner thicker portion.

4. The light bar assembly as claimed in claim 2, wherein said light bar assembly is mountable between a side edge wall of a ceiling board and a ceiling aluminium grid and said two ends of said mounting portion; and wherein said pair of ceiling engaging flange members is either placed above or below said ceiling aluminium grid.

5. The light bar assembly as claimed in claim 1, wherein said two ends are configured to be insertable into at least two brackets for installation of said light bar assembly onto a solid surface.

6. The light bar assembly as claimed in claim 1, wherein said light bar assembly is connectable to a suspension rod.

7. The light bar assembly as claimed in claim 6, wherein a supply cable from said suspension rod that is connected to at least one power converter unit is placed inside said second receiving slot of said lighting fixture and a cover is placed on top of said lighting fixture.

8. The light bar assembly as claimed in claim 2, wherein said two ends are insertable into at least two brackets, each of which includes two spring systems for installation of said light bar assembly.

9. The light bar assembly as claimed in claim 1, wherein said lighting fixture is insertable into metal trunking; wherein a portion of a trunking cover where said light bar assembly is positioned is cut and removed; and a remaining portion of said trunking cover at said two ends of said mounting portion are fastened to said metal trunking to secure said light bar assembly at said metal trunking.

10. The light bar assembly as claimed in claim 9, wherein a supply cable and a power supply are concealable in said metal trunking.

11. The light bar assembly as claimed in claim 1, wherein said light bar assembly further comprises:

a high-bay bracket assembly for installation of a plurality of light bar assemblies to a ceiling structure; wherein said high-bay bracket assembly includes at least one mounting plate for mounting to said ceiling structure, at least two mounting brackets for said plurality of light bar assemblies to be mounted therewith, and at least two connecting means, whereby at least one of said connecting means is used to connect each mounting bracket to one side of said mounting plate.

12. The light bar assembly as claimed in claim 11, wherein a power controller unit is attached to said mounting plate to control a power supply towards said plurality of light bar assemblies.

13. The light bar assembly as claimed in claim 11, wherein said mounting brackets are positioned perpendicularly at both sides of said plurality of light bar assemblies and each of said plurality of light bar assemblies is fastened to said mounting brackets by a fastening means.

14. A ceiling system, comprising:

a ceiling grid;

a plurality of panels supported by said ceiling grid; and a light bar, including:

at least one light source module and at least one reflector for light illumination;

at least one mounting portion to hold said light source module and said reflector, wherein a longitudinal axis extends lengthwise along said mounting portion;

a pair of ceiling engaging flange members extending outwardly from opposite sides of said mounting portion; and said mounting portion including two ends in a direction of said longitudinal axis;

said two ends are centrally located such that they are disposed between said ceiling engaging flange members relative to said longitudinal axis, wherein said two ends of said mounting portion extend beyond said ceiling engaging flange members in said direction of said longitudinal axis such that no portion of said ceiling engaging flange members extends outwardly from said two ends of said mounting portion, and wherein said light bar is directly supported on said ceiling grid by said two end portions, and at least one of said ceiling engaging flange members directly supports one of said panels.

15. The ceiling system as claimed in claim 14, wherein said light bar is directly supported on said ceiling grid by said two ends and one of said ceiling engaging flange members, wherein said one of said ceiling engaging flange members directly contacts said ceiling grid along its entire length.

16. The ceiling system as claimed in claim 14, wherein at least one of said ceiling engaging flange members is not in direct contact with said ceiling grid.

17. The ceiling system as claimed in claim 14, wherein said pair of ceiling engaging flange members are positioned at a lower part of said mounting portion.

18. The ceiling system as claimed in claim 14, wherein one of said pair of ceiling engaging flange members is provided with a cut-away portion at a bottom part of said one of said pair of ceiling engaging flange members to form an outer thinner portion and an inner thicker portion.

19. The ceiling system as claimed in claim 18, wherein said outer thinner portion is disposed above said ceiling grid and said inner thicker portion is disposed next to and in-line with a visible bottom surface of said ceiling grid.

* * * * *